US008424271B2

(12) United States Patent
Murarotto

(10) Patent No.: US 8,424,271 B2
(45) Date of Patent: Apr. 23, 2013

(54) PROCESS FOR WRAPPING LOADS, IN PARTICULAR PALLETISED LOADS, AND RELATIVE SYSTEM

(75) Inventor: Emilio Murarotto, Castelfranco Veneto (IT)

(73) Assignee: Bema S.R.L., Viano (RE) (IT)

( * ) Notice: Subject to any disclaimer, the term of this patent is extended or adjusted under 35 U.S.C. 154(b) by 382 days.

(21) Appl. No.: 12/937,424

(22) PCT Filed: Jul. 24, 2008

(86) PCT No.: PCT/IB2008/001928

§ 371 (c)(1),
(2), (4) Date: Oct. 12, 2010

(87) PCT Pub. No.: WO2009/130531

PCT Pub. Date: Oct. 29, 2009

(65) Prior Publication Data

US 2011/0030317 A1 Feb. 10, 2011

(30) Foreign Application Priority Data

Apr. 23, 2008 (IT) ..... MO2008A0122

(51) Int. Cl.
*B65B 13/02* (2006.01)

(52) U.S. Cl.
USPC ..... 53/399; 53/211; 53/397; 53/587

(58) Field of Classification Search ..... 53/399, 53/466, 211, 397, 587; 198/346.1, 369.6, 198/397, 861.6
See application file for complete search history.

(56) References Cited

U.S. PATENT DOCUMENTS 4,077,179 A 3/1978 Lancaster et al.
4,152,879 A * 5/1979 Shulman ..... 53/399
4,235,062 A * 11/1980 Lancaster et al. ..... 53/399
4,299,076 A * 11/1981 Humphrey ..... 53/587
4,450,668 A * 5/1984 Grossi ..... 53/176
4,458,467 A * 7/1984 Shulman et al. ..... 53/399
4,747,252 A * 5/1988 Kapke ..... 53/399
4,845,920 A * 7/1989 Lancaster ..... 53/399

(Continued)

FOREIGN PATENT DOCUMENTS

DE 39 06 922 10/1989
GB 2 069 967 9/1981
GB 2 143 200 2/1985

*Primary Examiner* — Hemant M Desai
*Assistant Examiner* — Gloria R Weeks
(74) *Attorney, Agent, or Firm* — Stein IP, LLC

(57) ABSTRACT

The process for wrapping loads, in particular palletised loads, comprises the following phases:

providing a rotating platform that is suitable for receiving a load to be wrapped and which has advancement means for advancing the load in an advancing direction, and a movement machine for moving a wrapping head along a substantially vertical direction for co-operating with the rotating platform to wrap the load with a covering sheet, the wrapping head having cutting means for cutting the covering sheet to form a cut end, and joining means for connecting the cut end to the load;

placing the load to be wrapped on the rotating platform;

wrapping the load on the rotating platform with the covering sheet to define a stabilizing wrap;

turning the rotating platform so the advancing direction is towards the wrapping head;

advancing the wrapped load on the rotating platform in the direction approaching the wrapping head until located in proximity to the head itself; and then cutting the covering sheet to form a cut end;

joining the cut end to the wrapped load.

15 Claims, 9 Drawing Sheets

U.S. PATENT DOCUMENTS 4,887,719 A * 12/1989 Kapke ..... 206/597
5,131,209 A * 7/1992 Schreiber et al. ..... 53/399
5,141,095 A * 8/1992 Kamp ..... 198/409
5,184,449 A * 2/1993 Hannen ..... 53/399
5,195,297 A * 3/1993 Lancaster et al. ..... 53/399
5,351,461 A * 10/1994 Fandard et al. ..... 53/157
5,564,264 A * 10/1996 DeCrane ..... 53/251
5,588,281 A * 12/1996 Boriani et al. ..... 53/443
6,543,200 B1 * 4/2003 Panzarella et al. ..... 53/75
6,775,956 B1 * 8/2004 Lacey ..... 53/399
6,925,776 B2 * 8/2005 DeGrasse ..... 53/399
7,124,560 B2 * 10/2006 Brieden ..... 53/587
7,581,368 B1 * 9/2009 Bison ..... 53/399
8,037,660 B2 * 10/2011 Lancaster et al. ..... 53/399
2005/0193687 A1 * 9/2005 Tosa ..... 53/399

* cited by examiner

PROCESS FOR WRAPPING LOADS, IN PARTICULAR PALLETISED LOADS, AND RELATIVE SYSTEM

CROSS-REFERENCE TO RELATED APPLICATIONS

This application claims the benefit of PCT International Patent Application No. PCT/IB2008/001928, filed Jul. 24, 2008, and Italian Patent Application No. MO2008A000122, filed Apr. 23, 2008, in the Italian Patent and Trademark Office, the disclosures of which are incorporated herein by reference.

BACKGROUND OF THE INVENTION

1. Field of the Invention

This invention refers to a process for wrapping loads, in particular palletised loads, and to a system for implementing the method.

2. Description of the Related Art

As is common knowledge, palletised loads consist of one or more goods distributed in a more or less orderly manner on a pallet so it can be moved and transported in a practical and easy way.

The palletised loads are normally covered with a stabilising wrap that immobilises the loads on the pallet so the loads can then be transported without any risk of falling or tipping over.

The usual way to make such stabilizing covering is to tightly wrap the sides of the load and pallet with a plastic covering film that is unwound from a dispensing reel.

Wrapping is normally done by means of either automatic or semi automatic wrapping stations, which use one or more machines, intended to move a wrapping head which supports the reel of plastic film.

In a particular type of wrapping station, the movement machine is made of a rotating frame that, to wrap the covering sheet on the load to be wrapped, supports the wrapping head, driving it with a lifting and rotating motion around the palletised load which remains substantially still on the supporting stand.

In another type of wrapping station, the movement machine consists of a vertical post along which the wrapping head slides while the palletised load turns on a rotating platform.

Both the supporting stand and the rotating platform of these two types of wrapping stations have a system for advancing the palletised load, e.g. a motorised roller unit, a chain conveyor or a mechanism type, that allows the palletised load to be transported along an automated movement line, stopping the load near the movement machine so it can be wrapped.

In both types, moreover, the reel is mounted on the wrapping head in a way that it rotates around its own axis and, during wrapping, is kept substantially vertical and parallel to the sides of the load.

Hence during wrapping the palletised load is wrapped with several spiral windings to achieve a particularly strong stabilising wrap.

At the end of wrapping, the plastic film is cut with a cutting device on the wrapping head and the end thus cut is sealed on the palletised load by a heat sealing pad.

The heat sealing pad is also mounted on the wrapping head which, in turn, is mounted on horizontal guides so it can be moved near to and away from the palletised load.

In both types of wrapping stations mentioned here, after the plastic film has been wrapped around the palletised load, the wrapping head moves up to the load, cuts the plastic film and seals the end thus formed making it integral with the stabilising wrap that is wrapping the palletised load.

Such wrapping stations do, however, have some drawbacks, among which is the fact that they are rather complex and complicated from both a structural and functional point of view.

In this regard, the fact is emphasized that the need for movement means on the wrapping head to move it near to and away from the palletised, load entails some considerable difficulties and complications, both during the assembly phase and when the wrapping stations are working, leading to a notable increase in manufacturing, installation and maintenance costs.

SUMMARY OF THE INVENTION

The main aim of this invention is to provide a process and system for wrapping loads, in particular palletised loads, that allow loads that have to be transported to be wrapped practically, easily, quickly and functionally and, at the same time, considerably reducing the overall transportation costs in terms of less expense for assembly, installation, maintenance and running of the wrapping system.

Another object of this invention is to provide a process and system for wrapping loads, in particular palletised loads, that make it possible to overcome the mentioned drawbacks of the known technique as part of a simple, rational, easy, effective use and low cost solution.

The aforementioned objects are achieved by this process for wrapping loads, in particular palletised loads, comprising the following phases, or steps:

providing at least one rotating platform that is suitable for receiving at least one load to be wrapped and which has advancement means for advancing said load in an advancing direction, and at least one movement machine for moving a wrapping head along a substantially vertical direction, which is suitable for co-operating with said rotating platform to wrap said load with a covering sheet, said wrapping head having cutting means of said covering sheet in order to form a cut end and joining means for connecting said cut end to said load;

placing said load to be wrapped on said rotating platform;

wrapping said load on said rotating platform with said covering sheet to define a stabilising wrap;

characterised by the fact that it comprises the following phases:

turning said rotating platform until said advancing direction is towards said wrapping head;

advancing said wrapped load on said rotating platform in the direction approaching said wrapping head until in proximity of the head itself;

cutting said covering sheet to form said cut end;

joining said cut end to said wrapped load.

The aforementioned objects are also achieved with this system for wrapping loads, in particular palletised loads, comprising at least one rotating platform which is suitable for receiving at least one load to be wrapped and which has advancement means of said load in an advancing direction, and at least one movement machine for moving a wrapping head in a substantially vertical direction for co-operating with said rotating platform to wrap said load with a covering sheet, said wrapping head having cutting means for cutting said covering sheet to form a cut end and joining means for connecting said cut end to said load, characterised by the fact that said rotating platform is associated to automated drive means suitable for advancing said wrapped load on said rotating platform in said advancing direction towards said wrapping head and to stop the load in a stopping position in proximity to said wrapping head.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
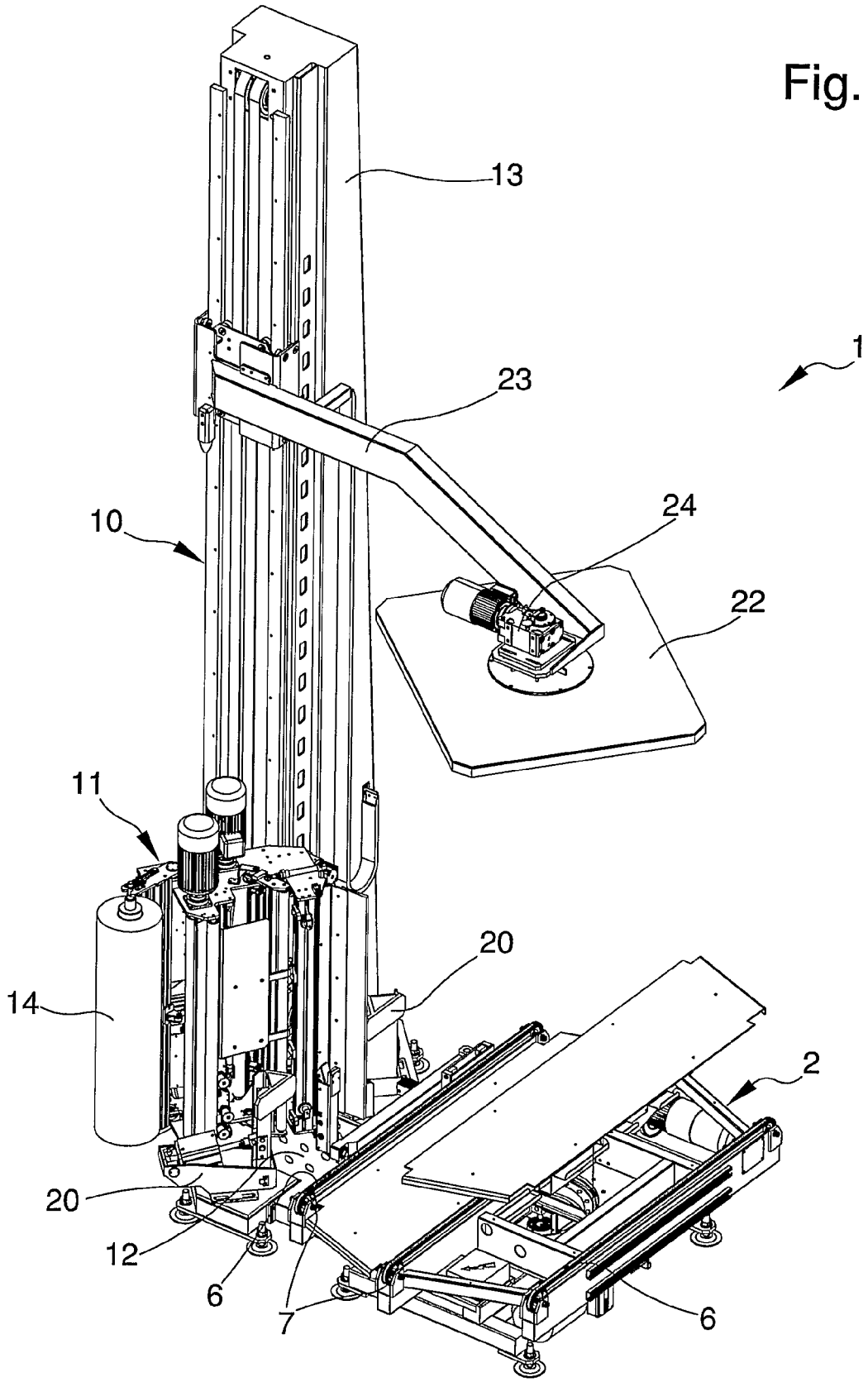
FIG. 1 is a perspective view of the system according to the invention.
Figure 2:
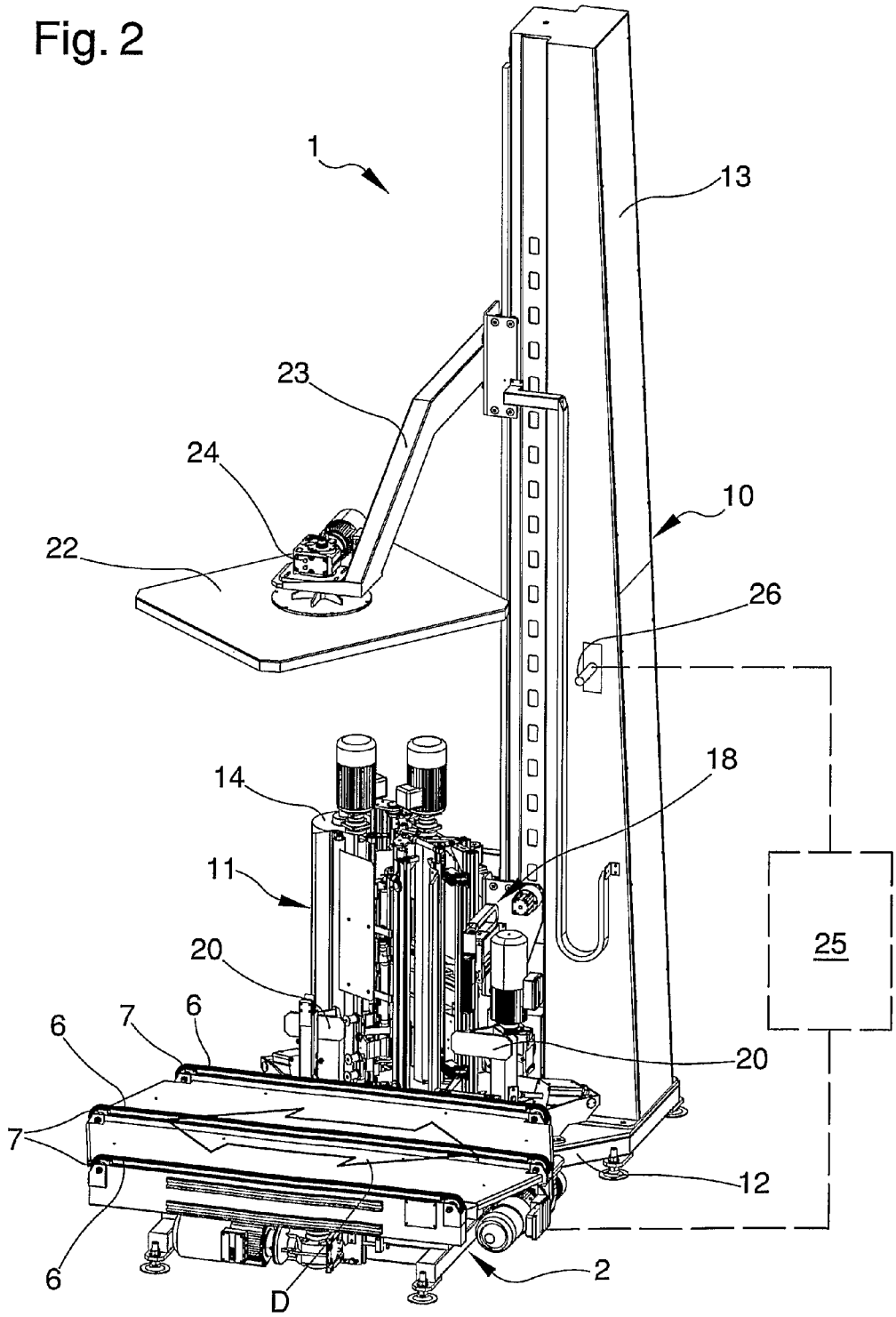
FIG. 2 is a perspective view, from another angle, of the system according to the invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

With particular reference to such figures, a system for wrapping loads, in particular palletised loads, has been globally indicated by 1.

The system comprises a rotating platform 2 which is suitable for receiving a load 3 to be wrapped and making the load rotate around a vertical rotation axis A.

In the particular embodiment of the invention illustrated in the figures, the load 3 is the palletised type and consists of one or more goods or items 4 loaded on a pallet 5; however, it is noted that the system 1 can also be used to wrap non palletised loads 3.

Advancement means 6, 7, suitable for moving the load 3 in an advancing direction D, are mounted on the rotating platform 2.

The advancement means 6, 7 consist, of a conveyor with a group of flexible elements 6 arranged in a loop and wrapped around a corresponding set of pairs of motorised wheels 7.

In the particular embodiment of the invention illustrated in the figures, the flexible elements 6 are composed of a plurality of chains, parallel with one another. However other solutions are possible where the flexible elements 6 consist of a band (slat conveyor), or where the conveyor 6, 7 is of the roller type.

An approaching or input conveyor moves the load 3 to be wrapped close to rotating platform 2. The approaching line or input conveyor 8 may consist of a first motorised roller unit.

To allow movement of the load 3 coming from the first motorised roller unit 8 and its passage on the rotating platform 2, the platform rotates to align the advancing direction D with the approaching line 8.

Similarly, the rotating platform 2 is also operatively associated with a moving away line 9 to move the wrapped load 3. The moving away line, which may be deemed as a discharge conveyor, consists of a second motorised roller unit 9.

Once wrapping is completed, the rotating platform 2 can rotate until the advancing direction D is towards the moving away line 9 so the load 3 can be discharged from the rotating platform 2 to the second motorised roller unit 9.

Movement machine 10, suitable for lifting and lowering a wrapping head 11 in a substantially vertical direction, is situated in proximity to the platform 2.

The movement machine 10 has a base 12 resting on the ground A post 13 extends substantially vertically along which the wrapping head 11 is engaged in a sliding manner.

The wrapping head 11 carries a reel 14 on which a covering sheet 15, made of a thermoplastic material to wrap around the load 3, is wound.

During wrapping, the movement machine 10 cooperates with the rotating platform 2 to wrap the load 3 with the covering sheet 15. The rotating platform 2 turns and, simultaneously, lifts and lowers the wrapping head 11 so the load 3 can be wound, thus forming a stabilising wrap 16 around it.

The wrapping head 11 includes cutter 17 for cutting the covering sheet 15 after the wrapping is finished. Cutter 17 forms a cut end which seperates the stabilising wrap 16, wrapped around the load 3, from the reel 14 mounted on the wrapping head 11.

Figure 3:
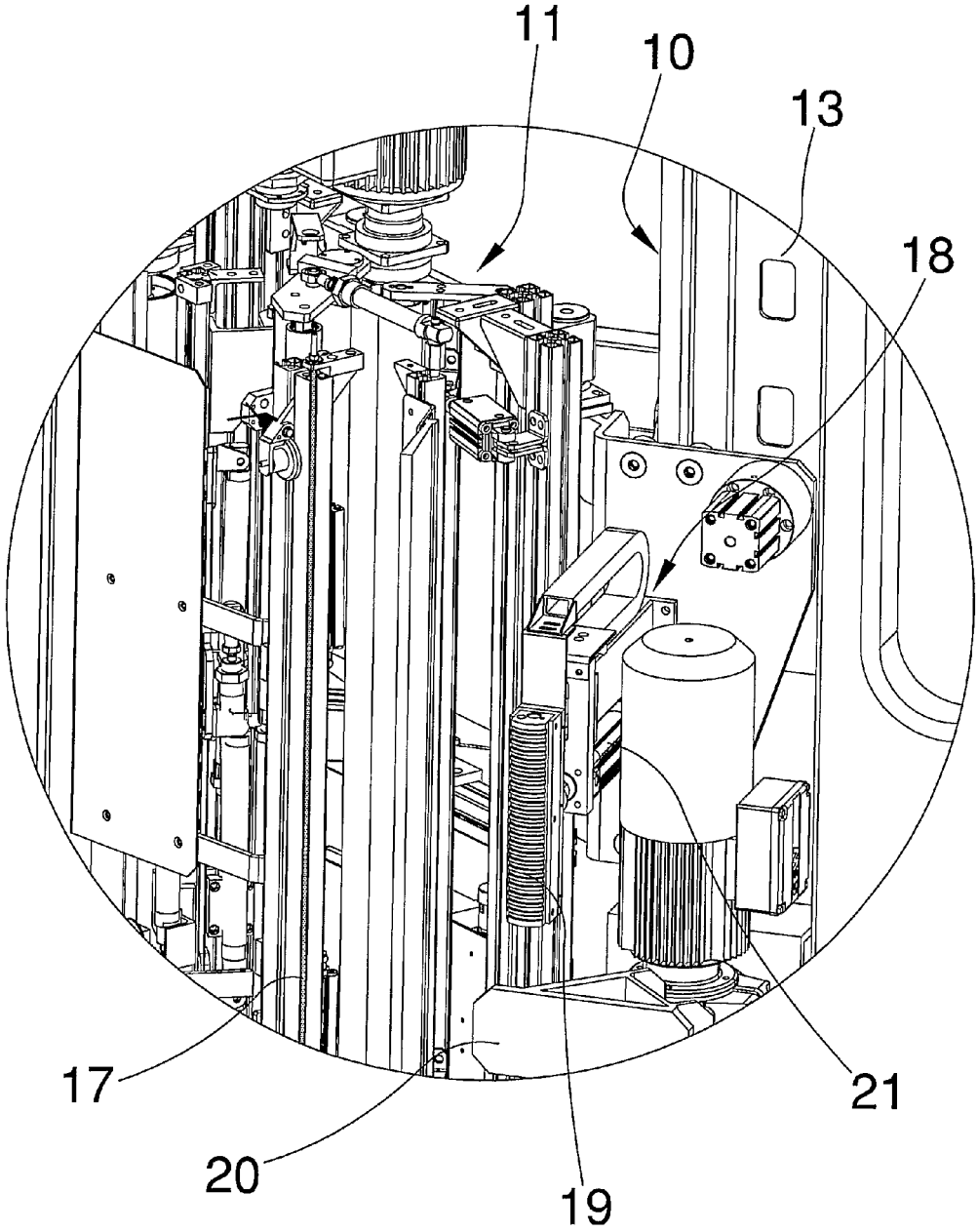
FIG. 3 is a perspective view, on an enlarged scale, of a detail of FIG. 2.
Figure 4:
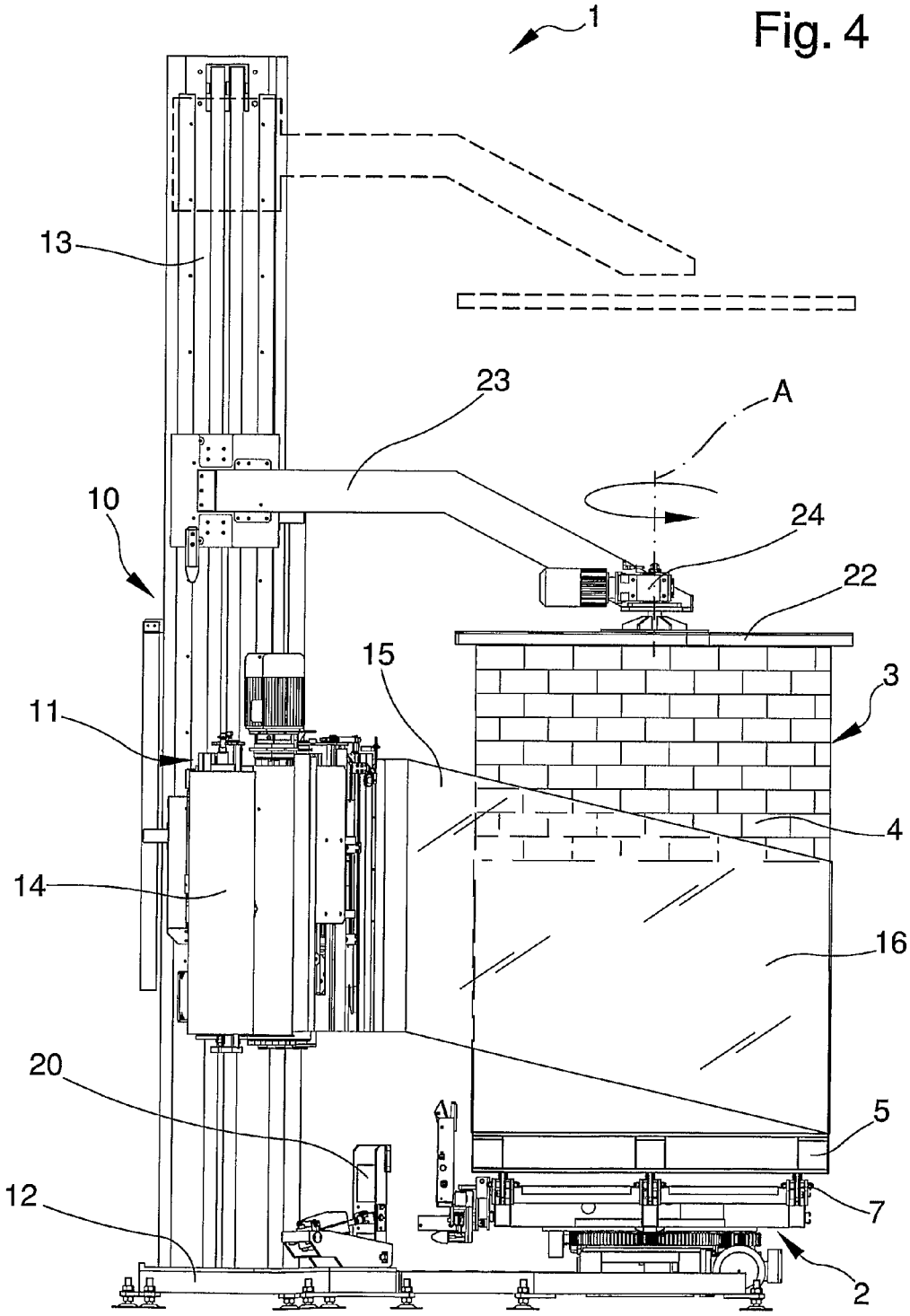
FIG. 4 is a side view of the system according to the invention during the wrapping phase.

Cutter 17 can be seen in detail in FIG. 3 comprises a cutting wire associated with heating means.

The heating means are not illustrated in the figures but are suitable for heating the cutter 17 to help it penetrate and sever the covering sheet 15.

However, alternative embodiments of this invention are possible wherein the cutter 17 assumed the form of a serrated blade for cold cutting the covering sheet 15.

The wrapping head 11 has joining means 18 to connect the cut end to the stabilising wrap 16 that is wound around the load 3 when wrapping has finished.

The joining means 18 are of the heat sealing type and comprise a heated pad 19 applicable to the cut end so it can be sealed to the stabilising wrap 16. Cutter 17 is located in proximity to joining means 18.

Both cutter 17 and the pad 19 are arranged on the wrapping head 11 in proximity to a substantially vertical worktop P arranged at a pre-established distance from the rotation axis A.

For the cutter 17 and the pad 19 to work on the covering sheet 15 and on the stabilising wrap 16, the system 1 is designed to feed the load 3 in the advancing direction D on the conveyor 6, 7 up to the worktop P, thus bringing the load in proximity of the cutter 17 and joining means 18.

To this end, the rotating platform 2 is operatively associated with automated drive means 25 suitable for controlling the conveyor 6, 7 and advancing the load 3 in the direction approaching the wrapping head 11 and to stop it in a stopping position in proximity of the worktop P.

The automated drive means 25 are of the management and control unit type which is operatively associated to detection means 26 suitable for detecting when the load 3 has reached the stopping position.

In the particular embodiment of the invention illustrated in the figures, the detection means 26 are composed of a contact-free sensor, of the optical type, laser type or the like, mounted on the movement machine or close to it; however, other embodiments are possible where the detection means 26 consist of a feeler element or other mechanical devices which detect the position of the load 3 by means of contact.

Near the worktop P are also arranged two obstacle devices 20 which are mounted on the base 12 of the movement machine 10 and act as bumpers to counteract advancement of the load 3 in the advancing direction D in the event it goes beyond the stopping position.

In particular, the obstacle devices 20 are composed of two position-adjustable bumper elements arranged on opposite sides with respect to the wrapping head 11, i.e. in proximity to its sides.

Once the load 3 is arranged in the stopping position, application of the pad 19 on the stabilising wrap 16 takes place by means of a jack 21 that is mounted on the wrapping head 11 and is arranged substantially crosswise to the worktop P.

The jack 21 is presses the pad 19 against the load 3 with a pre-established force, sufficient to form a seal between the stabilising wrap 16 and the cut end of the covering sheet 15.

Advantageously, in contact with the top of the load 3, a pressing element 22 holds the load 3 during wrapping.

The pressing element 22 consists of a horizontal table mounted on a support 23, of the arm type, which extends jutting from the post 13 and which is engaged, in a sliding manner, in the vertical direction defined by the post itself.

The pressing element 22 is mounted at the free end of the arm 23 and, by means of an electric motor 24, can be made to turn around the rotation axis A in synchronisation with the rotating platform 2.

Figure 5:
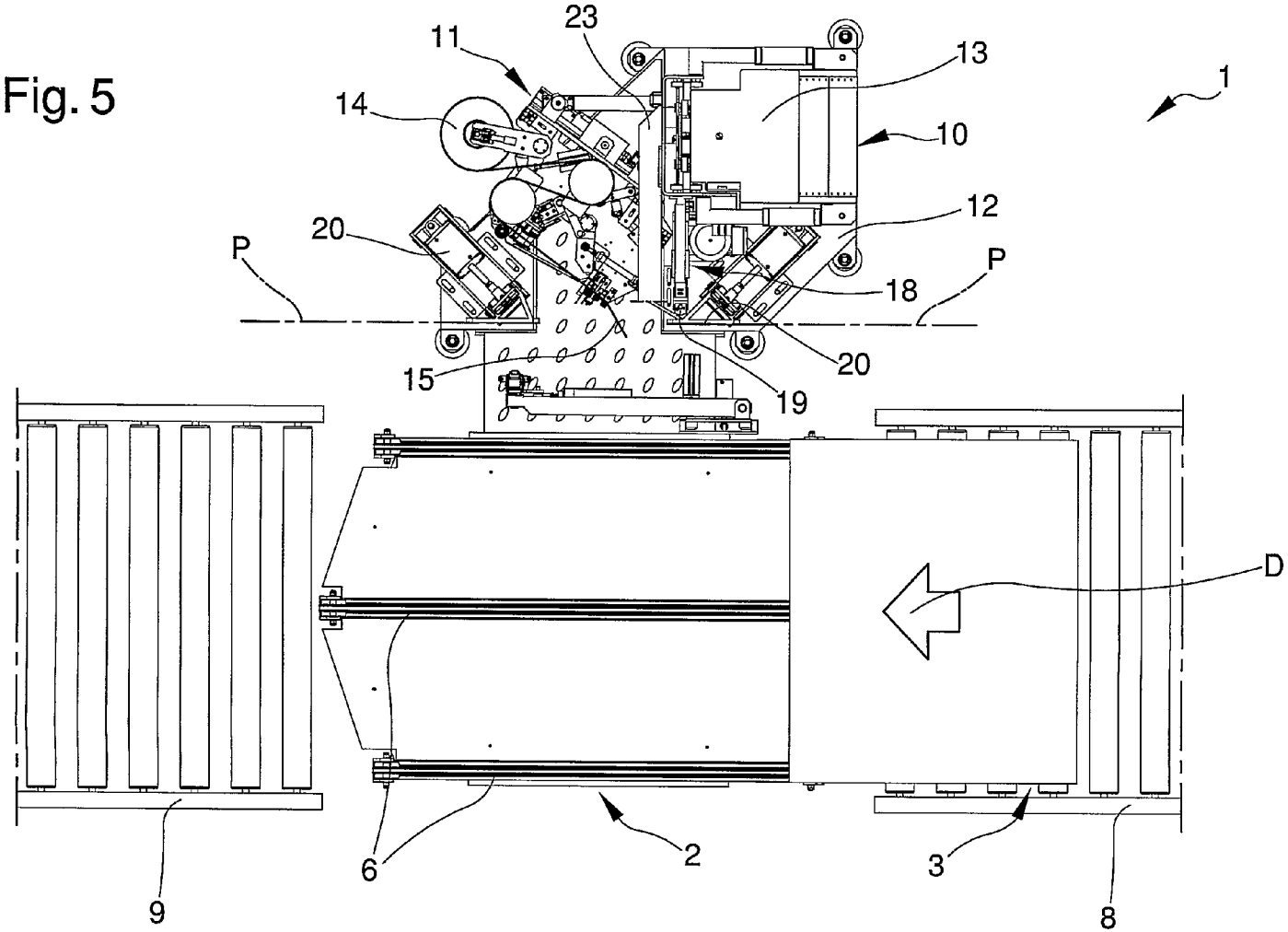
FIGS. 5 to 9 are a sequence of plan views showing the operation of the system according to the invention.
Figure 6:
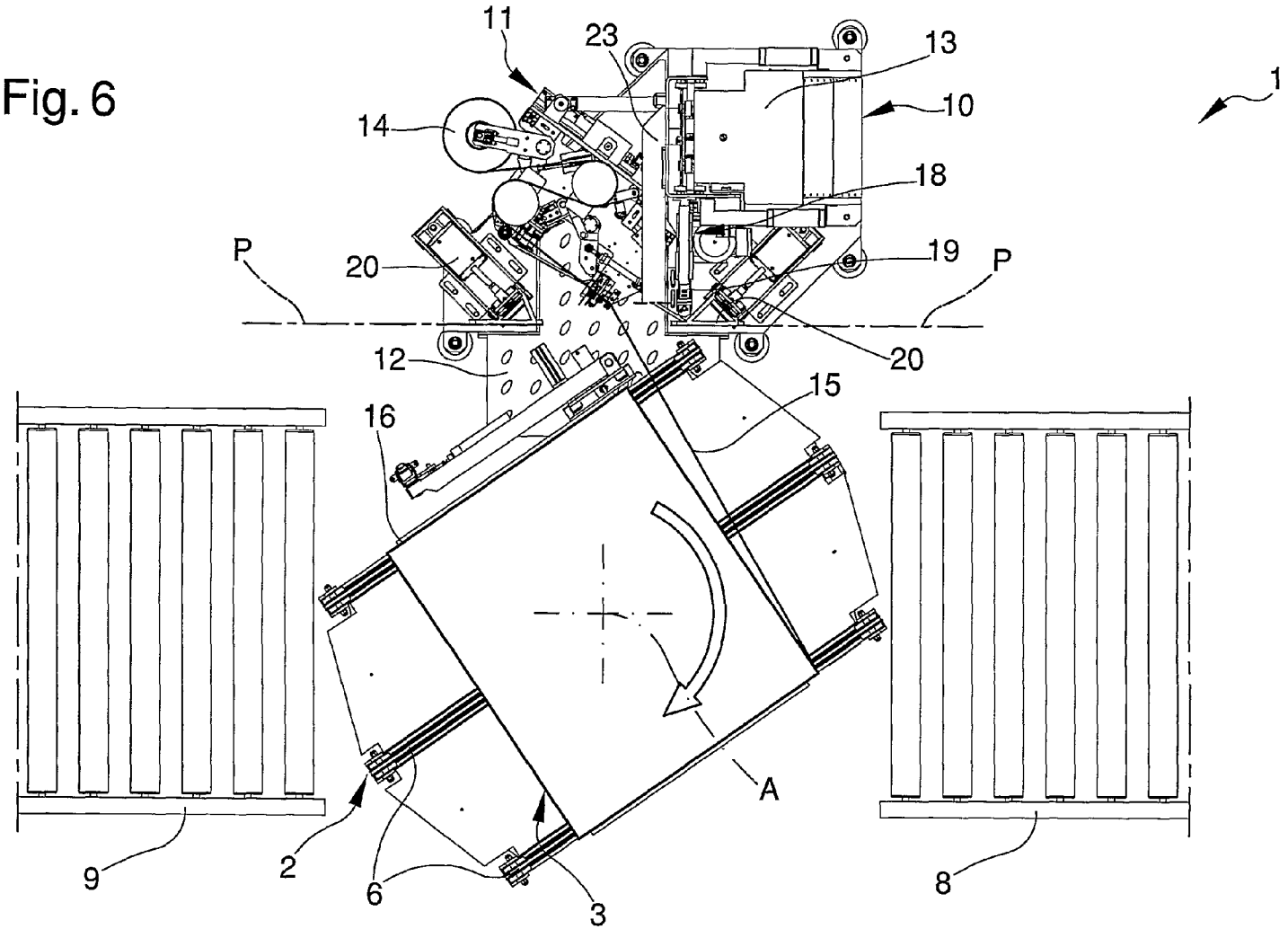
Figure 7:
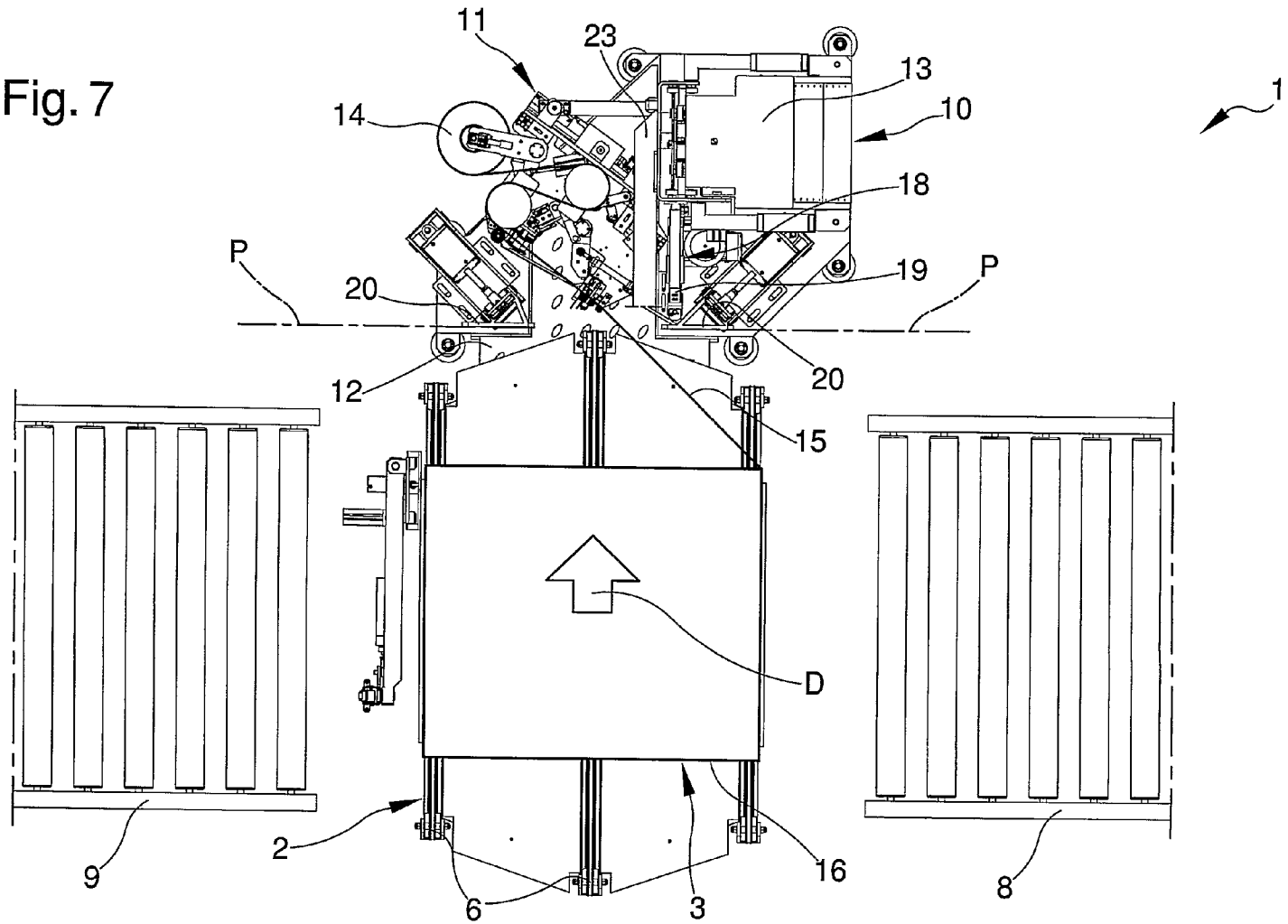
Figure 8:
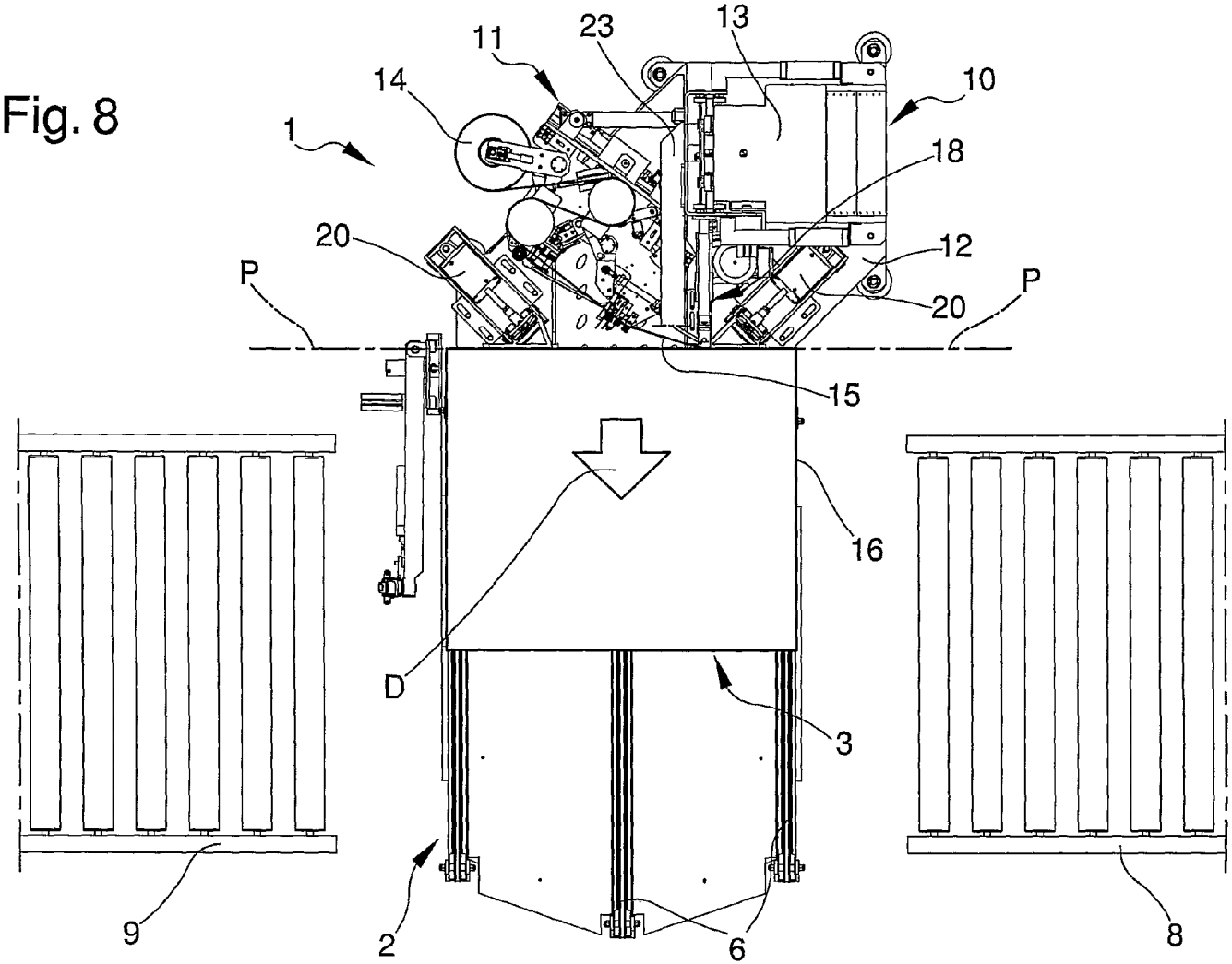
Figure 9:
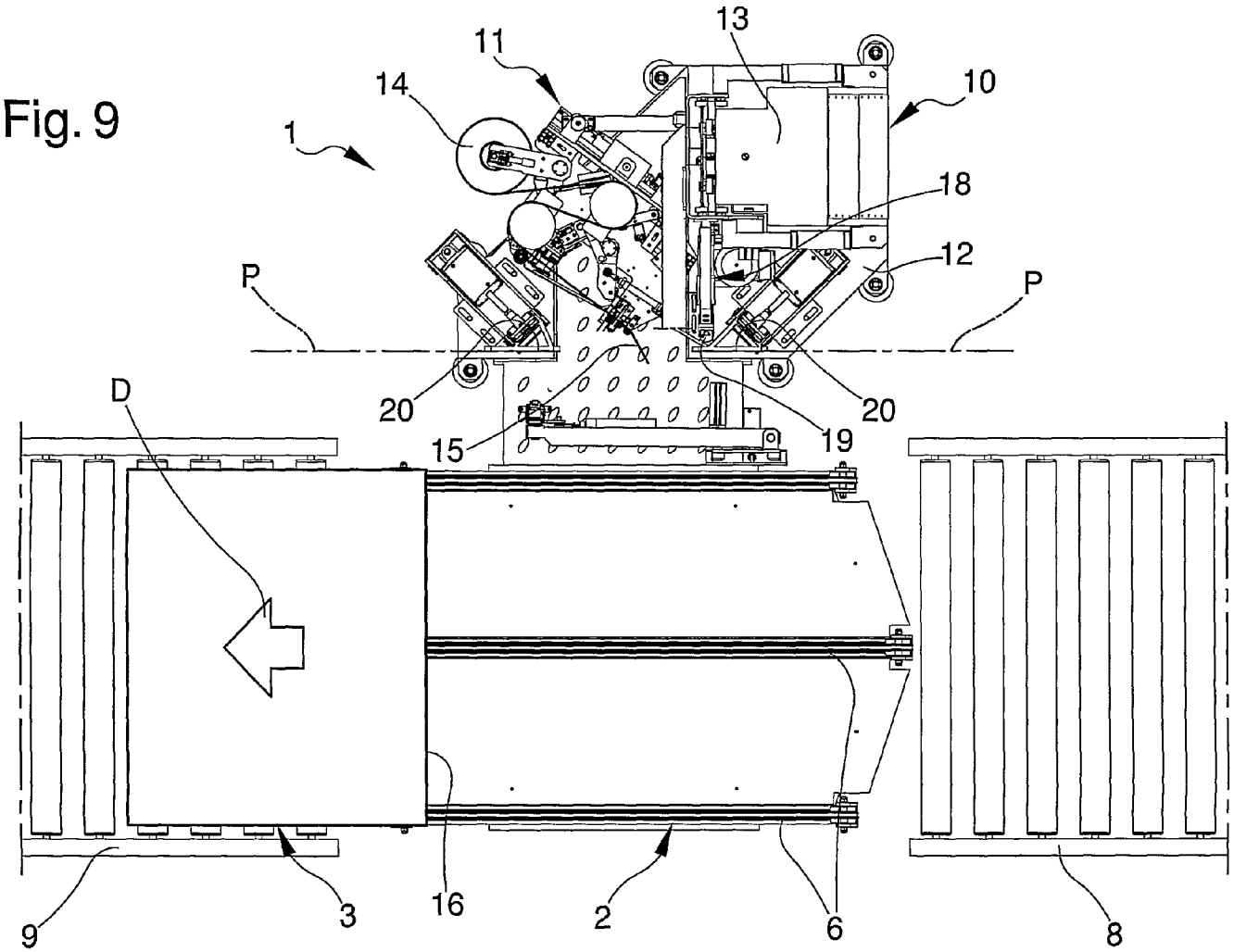

Wrapping of the load 3, by means of system 1, is carried out according to the process according to the invention which consists of the following phases, or steps:

- providing the rotating platform 2 and the movement machine 10 for moving the wrapping head 11;
- placing the load 3 on the rotating platform 2, making the load proceed along the approaching line 8 aligned with the advancing direction D of the rotating platform 2 (FIG. 5);
- wrapping the load 3 on the rotating platform 2 with the covering sheet 15 thus defining the stabilising wrap 16 (FIG. 6). This phase is achieved by making the wrapping head 11 slide along the post 13 and, simultaneously, making the rotating platform 2 turn. To carry out this operation in an easier way it is possible to apply the pressing element 22 in contact with the top of the load 3, driving it in rotation in synchronization with the rotating platform 2 during wrapping and then move it away from the top of load 3 when wrapping is finished;
- turning the rotating platform 2 until the advancing direction D is towards the wrapping head 11 (FIG. 7);
- advancing the load 3 along the rotating platform 2 in the direction approaching the wrapping head 11 until it is in proximity of the worktop P (FIG. 8);
- cutting the covering sheet 15 to form the cut end, approaching the covering sheet 15 and the heated cutting wire 17;
- joining, by heat sealing, the cut end to the stabilising wrap 16 wrapped around the load 3, operating the jack 21 to bring the pad 19 close to the worktop P so it is in contact with the cut end and with the stabilising wrap 16;
- advancing the load 3 along the rotating platform 2 in the moving away direction from the wrapping head 11;
- turning the rotating platform 2 until the advancing direction D is towards the moving away line 9;
- advancing the load 3 wrapped on the rotating platform 2 in the advancing direction D until the load 3 is positioned on the moving away line 9 (FIG. 9).

The manner in which the described invention achieves the proposed objects has now been clearly described.

The invention thus conceived is susceptible of numerous modifications and variations, all of which fall within the scope of the inventive concept.

Furthermore all the details can be replaced with others that are technically equivalent.

In practice, the materials used, as well as the contingent shapes and dimensions, may be varied to address commercial requirements without moving beyond the scope of protection afforded by the following claims. Consequently, the claims should be broadly construed in a manner consistent with the spirit of the invention, and should not be limited to their exact terms.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A process for wrapping loads, in particular palletised loads, comprising the following steps:

- providing at least one rotating platform for receiving at least one load to be wrapped, advancement means for advancing said load in an advancing direction, and at least one movement machine for moving a wrapping head in a substantially vertical direction, for co-operating with said rotating platform to wrap said load with a covering sheet, said wrapping head having a cutter for severing of said covering sheet in order to form a cut end and joining means for connecting said cut end, to said load;
- placing said load to be wrapped on said rotating platform;
- wrapping said load on said rotating platform with said covering sheet to define a stabilising wrap;
- turning said rotating platform until said advancing direction is towards said wrapping head;
- advancing said wrapped load on said rotating platform in the direction approaching said wrapping head until in proximity of the head itself;
- cutting said covering sheet to form said cut end;
- joining said cut end to said wrapped load.

2. The process according to claim 1, wherein said load to be wrapped proceeds along an approaching line that is aligned with the advancing direction of the rotating platform.

3. The process according to claim 1, wherein said wrapping head slides along a substantially vertical post with which the wrapping head is engaged.

4. The process according to claim 3, wherein said wrapping comprises making said rotating platform turn while said wrapping head slides along said post.

5. The process according to claim 1, wherein said process includes applying a pressing element in contact with the top of said load during said wrapping.

6. The process according to claim 5, wherein said process comprises rotating said pressing element in synchronization with said rotating platform during said wrapping.

7. The process according to claim 5, wherein said process involves moving said pressing element away from the top of said wrapped load before advancing said load towards said wrapping head.

8. The process according to claim 1, wherein said cutter approaches said covering sheet to sever same.

9. The process according to claim 8, including heating the cutter prior to contact with the covering sheet.

10. The process according to claim 1, further comprises sealing said cut end to said stabilising wrap.

11. The process according to claim 10, further comprises applying at least one heated pad to said cut end of said stabilising wrap.

12. The process according to claim 1, further comprises advancing said wrapped load on said rotating platform in the moving away direction from said wrapping head.

13. The process according to claim 12, further comprises turning said rotating platform until said advancing direction is towards the discharger line for said wrapped load.

14. The process according to claim 13, further comprises advancing said wrapped load on said rotating platform until placing said wrapped load on said moving away line.

15. The process according to claim 1, further comprises advancing said load on said rotating platform by utilizing at least one conveyor mounted on said rotating platform.

* * * * *